US009238937B2

(12) United States Patent
Costa

(10) Patent No.: US 9,238,937 B2
(45) Date of Patent: Jan. 19, 2016

(54) FLASHING AND JOINER FOR WINDOW INSTALLATIONS

(71) Applicant: Dean Costa, Mountain Creek (AU)

(72) Inventor: Dean Costa, Mountain Creek (AU)

(73) Assignee: SMART REVEAL PTY LTD, Kawana Waters, QLD (AU)

( * ) Notice: Subject to any disclaimer, the term of this patent is extended or adjusted under 35 U.S.C. 154(b) by 0 days.

(21) Appl. No.: 14/265,893

(22) Filed: Apr. 30, 2014

(65) Prior Publication Data

US 2014/0318035 A1 Oct. 30, 2014

(30) Foreign Application Priority Data

Apr. 30, 2013 (AU) ..... 2013901507
Sep. 12, 2013 (AU) ..... 2013903516

(51) Int. Cl.

| | |
|---|---|
| ***E06B 1/04*** | (2006.01) |
| ***E06B 7/14*** | (2006.01) |
| ***E06B 3/96*** | (2006.01) |
| ***E06B 3/968*** | (2006.01) |
| ***E06B 1/02*** | (2006.01) |
| ***E06B 1/34*** | (2006.01) |
| ***E06B 1/68*** | (2006.01) |
| *E06B 3/964* | (2006.01) |
| *E06B 1/70* | (2006.01) |

(52) U.S. Cl.

CPC ... *E06B 7/14* (2013.01); *E06B 1/02* (2013.01); *E06B 1/342* (2013.01); *E06B 1/68* (2013.01); *E06B 3/9616* (2013.01); *E06B 3/9632* (2013.01); *E06B 3/9647* (2013.01); *E06B 3/9684* (2013.01); *E06B 1/702* (2013.01); *E06B 3/9641* (2013.01)

(58) Field of Classification Search

CPC ... E06B 3/9647; E06B 3/9684; E06B 3/9632; E06B 3/9616; E06B 3/9641

USPC ..... 52/60, 62, 204.2, 204.53, 204.54, 212, 52/656.4, 656.5, 656.9

See application file for complete search history.

(56) References Cited

U.S. PATENT DOCUMENTS

| | | | | | |
|---|---|---|---|---|---|
| 2,822,761 | A | * | 2/1958 | Herring | 52/61 |
| 4,164,105 | A | * | 8/1979 | Herbst et al. | 52/202 |
| 4,205,486 | A | * | 6/1980 | Guarnacci | 49/501 |
| 4,555,869 | A | * | 12/1985 | Kenkel | 49/449 |
| 4,852,312 | A | * | 8/1989 | Harbom | 52/126.3 |

(Continued)

FOREIGN PATENT DOCUMENTS

| | | | | |
|---|---|---|---|---|
| DE | 3812104 A1 | * | 10/1989 | E06B 3/96 |
| DE | 102011107589 | * | 1/2013 | E06B 3/964 |

(Continued)

*Primary Examiner* — Adriana Figueroa

(74) *Attorney, Agent, or Firm* — Bay State IP, LLC

(57) ABSTRACT

A support frame for a window frame is provided to address the problem of unwanted entry of moisture, such as condensation, into a building in which the window frame is mounted. The support frame includes four sections of flashing. Each section of flashing has a window frame support plate that has a window frame side and building framework side. A first longitudinal wall extends from the window frame side of the support plate. One or more longitudinal stiffening box sections continuous with the plate are provided for imparting rigidity to the flashing. Two of the sections comprise sill and header flashings spaced apart at either end by the remaining two sections, which comprise jamb flashings. Joiners connect adjacent ends of the four sections.

5 Claims, 20 Drawing Sheets

(56) References Cited

U.S. PATENT DOCUMENTS

| | | | | |
|---|---|---|---|---|
| 5,339,588 | A * | 8/1994 | Ballstadt | 52/308 |
| 5,473,853 | A * | 12/1995 | Guillemet et al. | 52/745.16 |
| 5,630,297 | A * | 5/1997 | Rutherford | 52/58 |
| 6,076,314 | A * | 6/2000 | Simonton et al. | 52/204.1 |
| 6,401,402 | B1 * | 6/2002 | Williams | 52/58 |
| 6,526,709 | B1 * | 3/2003 | Jacobsen | 52/211 |
| 6,807,778 | B2 * | 10/2004 | Engebretson | 52/204.59 |
| 7,676,996 | B2 * | 3/2010 | Teodorovich | 52/204.2 |
| 7,797,884 | B2 * | 9/2010 | Allen | 52/58 |
| 8,028,489 | B1 * | 10/2011 | Lawrence | 52/656.7 |
| 8,117,789 | B2 * | 2/2012 | Teodorovich | 52/209 |
| 8,322,091 | B2 * | 12/2012 | Smith et al. | 52/208 |
| 8,443,554 | B1 * | 5/2013 | Teodorovich | 49/506 |
| 8,448,386 | B2 * | 5/2013 | Floren et al. | 52/60 |
| 8,490,347 | B2 * | 7/2013 | Valler et al. | 52/204.1 |
| 8,561,357 | B2 * | 10/2013 | Teodorovich | 52/58 |
| 8,695,293 | B2 * | 4/2014 | Teodorovich | 52/209 |
| 2001/0014250 | A1 * | 8/2001 | Plummer et al. | 403/295 |
| 2003/0106269 | A1 * | 6/2003 | Bauman et al. | 49/467 |
| 2003/0177712 | A1 * | 9/2003 | Gatherum | 52/60 |
| 2005/0050815 | A1 * | 3/2005 | Engebretson | 52/204.52 |
| 2005/0055912 | A1 * | 3/2005 | Teodorovich | 52/261 |
| 2005/0160677 | A1 * | 7/2005 | Gepfrey et al. | 49/504 |
| 2005/0262771 | A1 * | 12/2005 | Gorman | 49/408 |
| 2006/0075700 | A1 * | 4/2006 | Broad et al. | 52/212 |
| 2007/0220818 | A1 * | 9/2007 | Teodorovich | 52/204.1 |
| 2012/0186665 | A1 * | 7/2012 | Vos et al. | 137/343 |

FOREIGN PATENT DOCUMENTS

| | | | | |
|---|---|---|---|---|
| FR | 2571774 | A1 * | 4/1986 | E06B 3/96 |
| FR | 2682739 | A1 * | 4/1993 | F16S 3/08 |
| GB | 191004146 | A * | 0/1910 | E06B 3/964 |
| GB | 2140853 | A * | 12/1984 | E06B 3/05 |
| NZ | 195139 | | 10/1980 | |
| NZ | 537854 | | 1/2005 | |
| NZ | 588308 | | 6/2012 | |

* cited by examiner

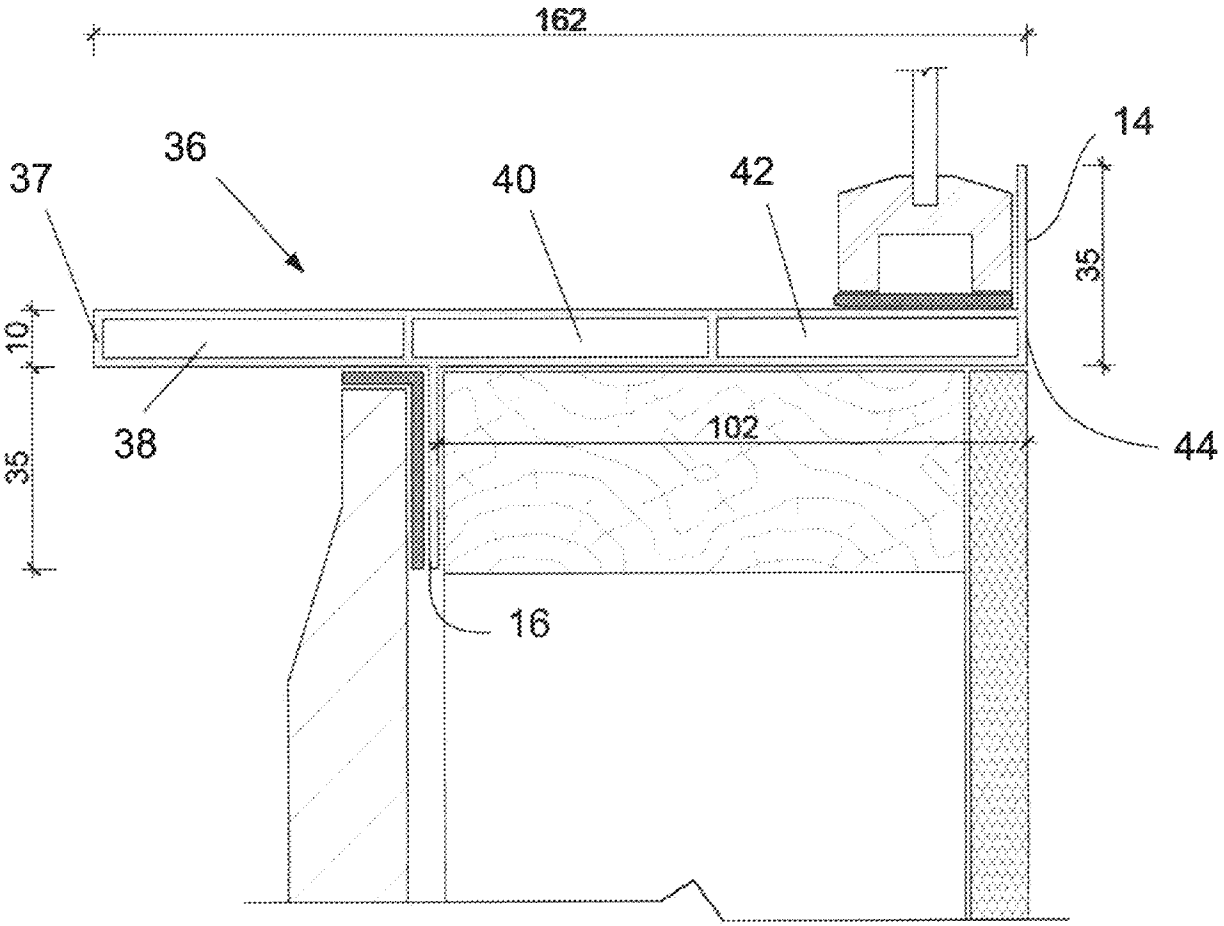
Figure 8a 90MM TIMBER FRAME FLUSH REVEAL

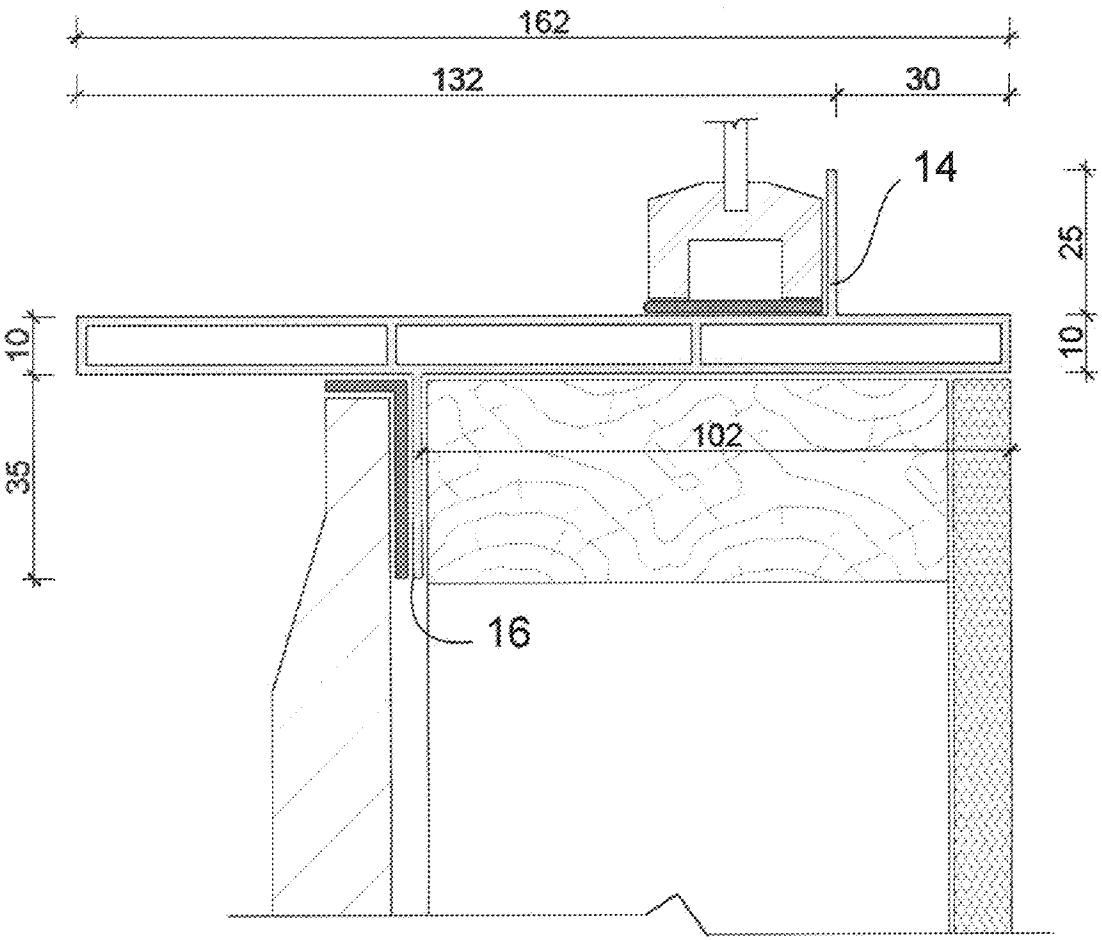
Figure 9 90MM TIMBER FRAME 30MM REVEAL

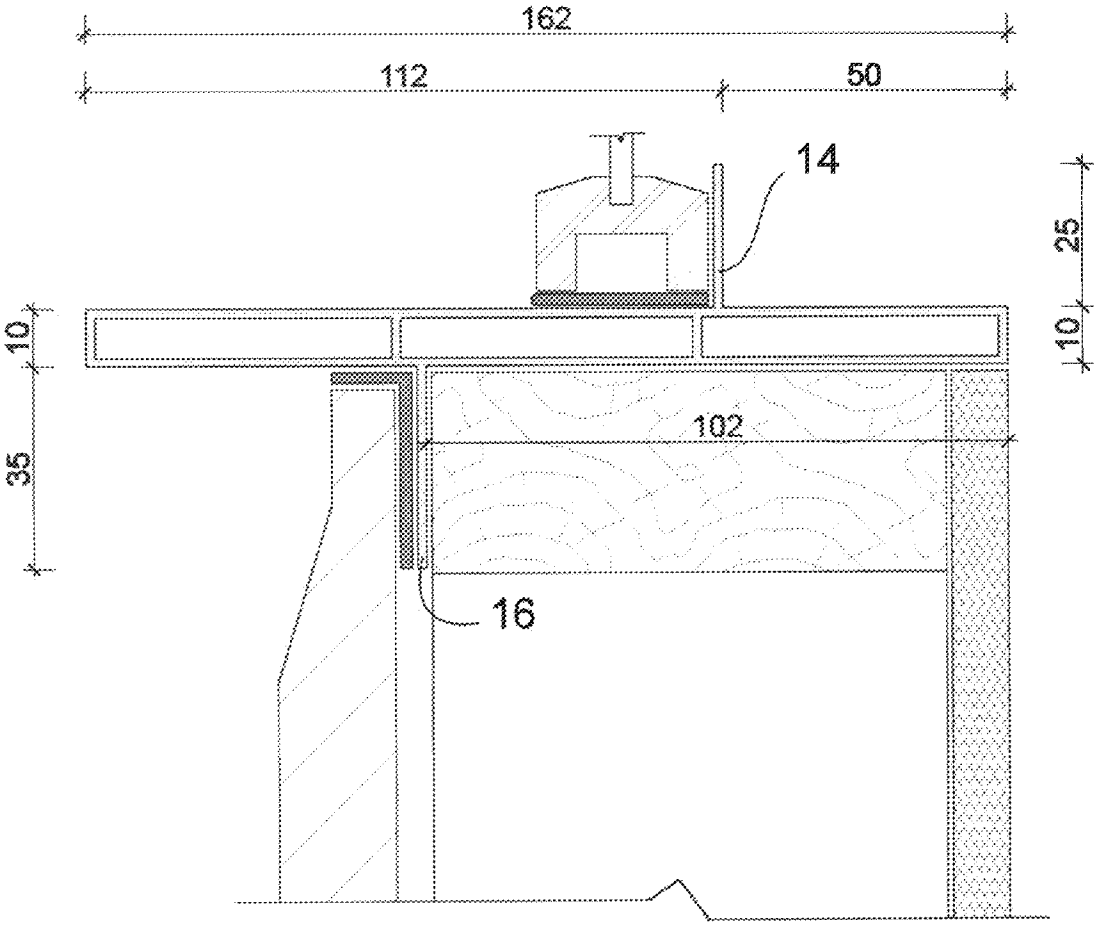
Figure 10 90MM TIMBER FRAME 50MM REVEAL

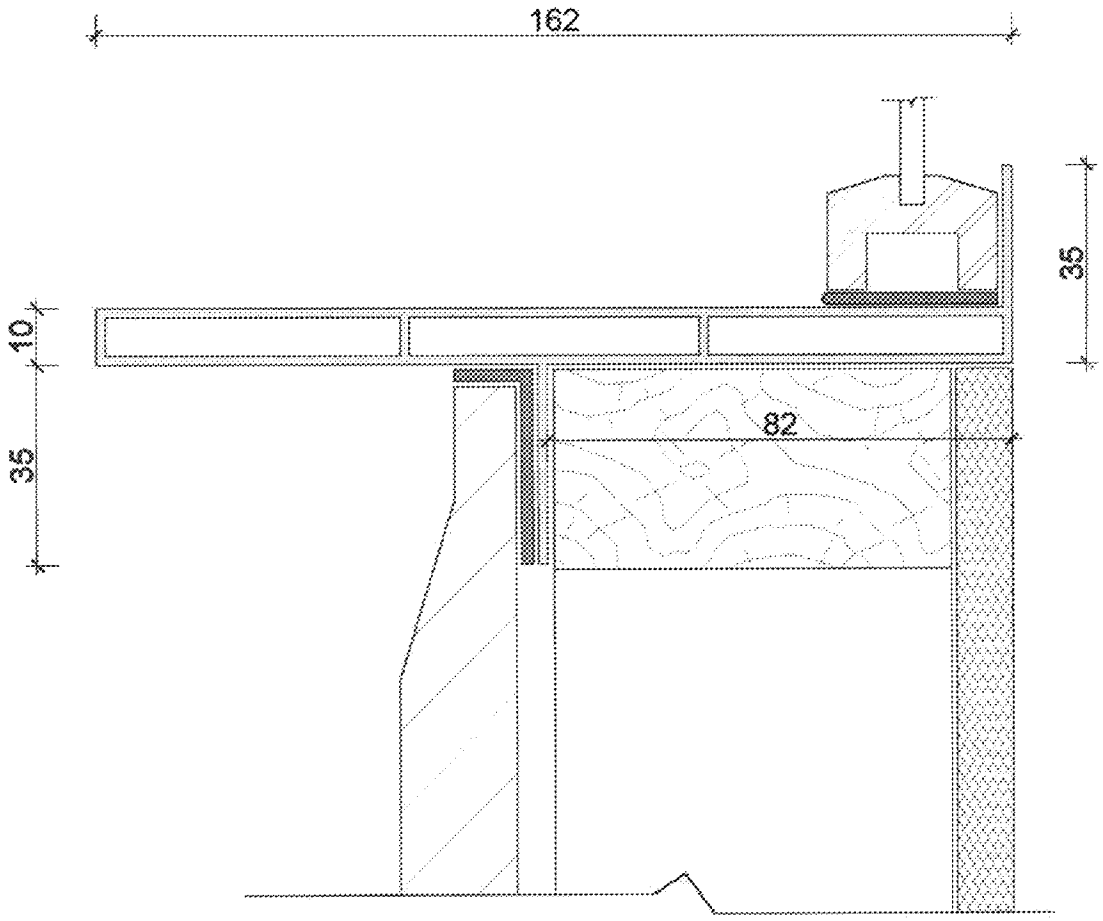
Figure 11 70MM TIMBER FRAME FLUSH REVEAL

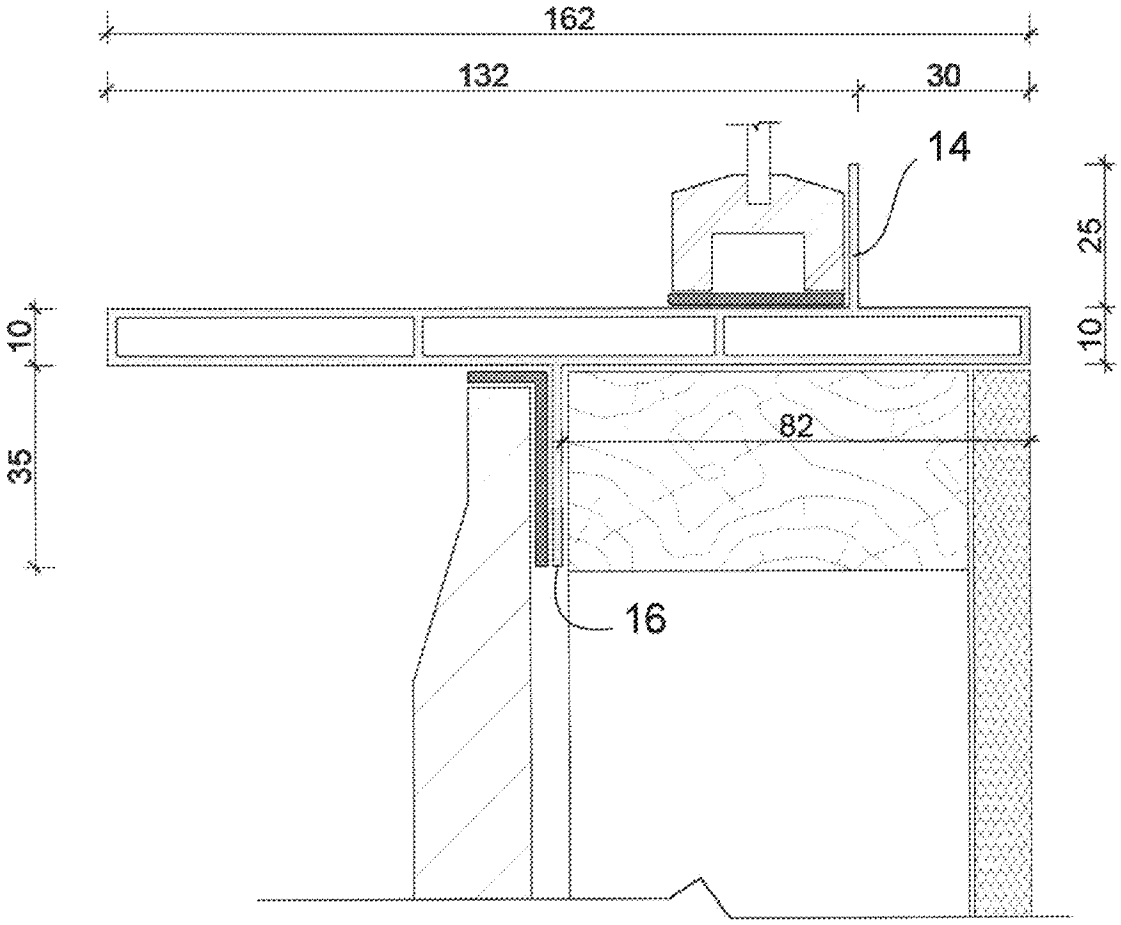
Figure 12 70MM TIMBER FRAME 30MM REVEAL

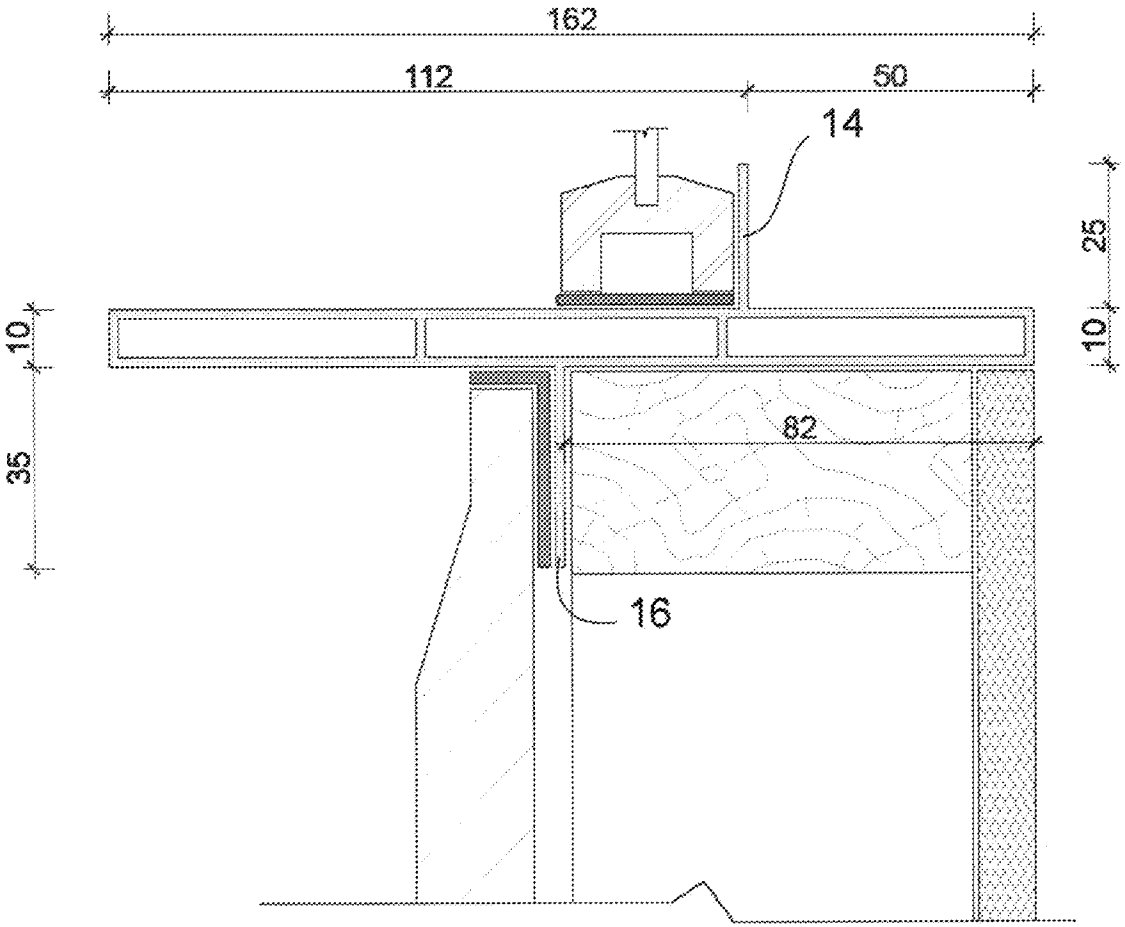
Figure 13 70MM TIMBER FRAME 50 REVEAL

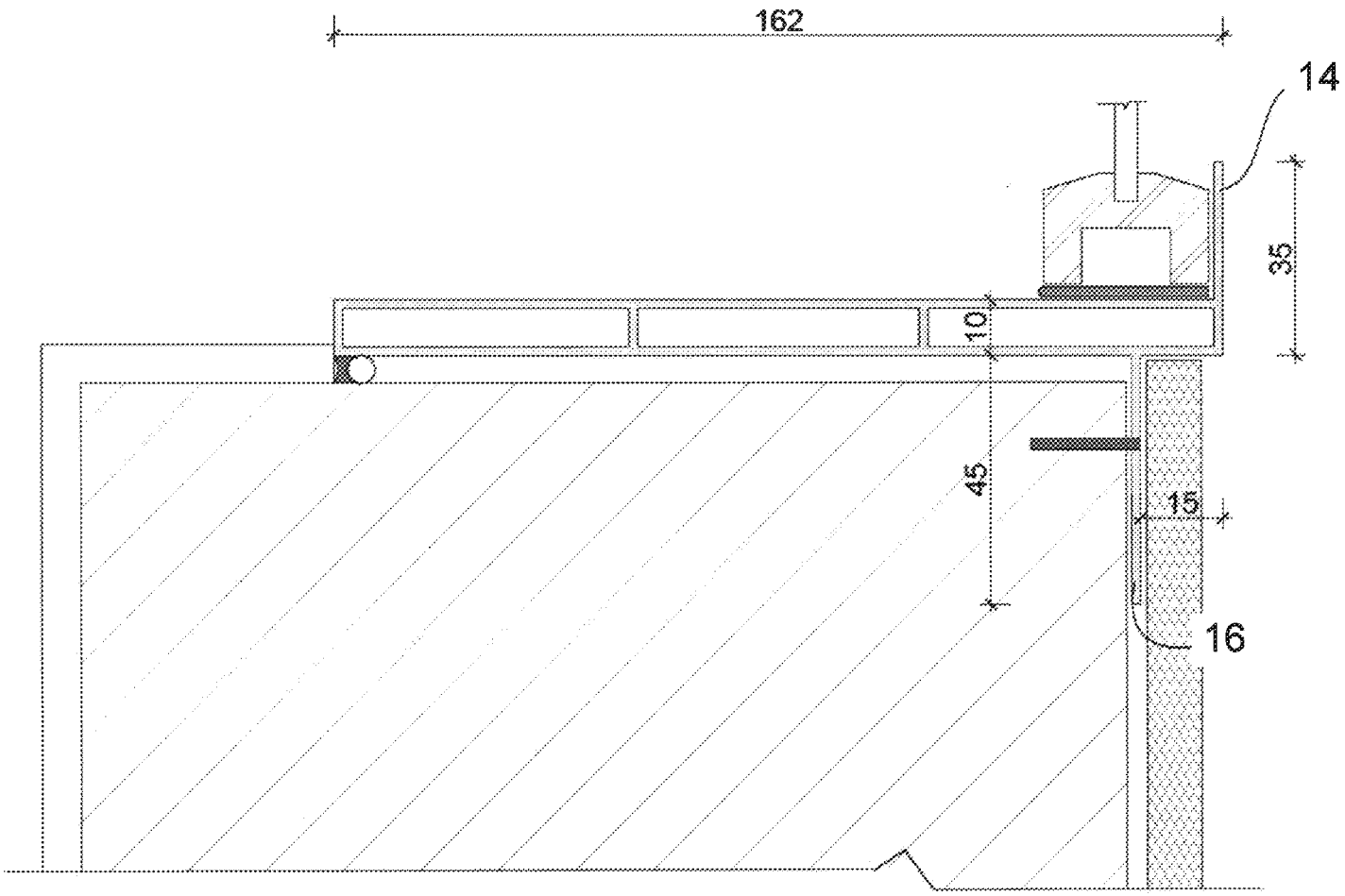
Figure 14 190MM MASONRY FLUSH REVEAL

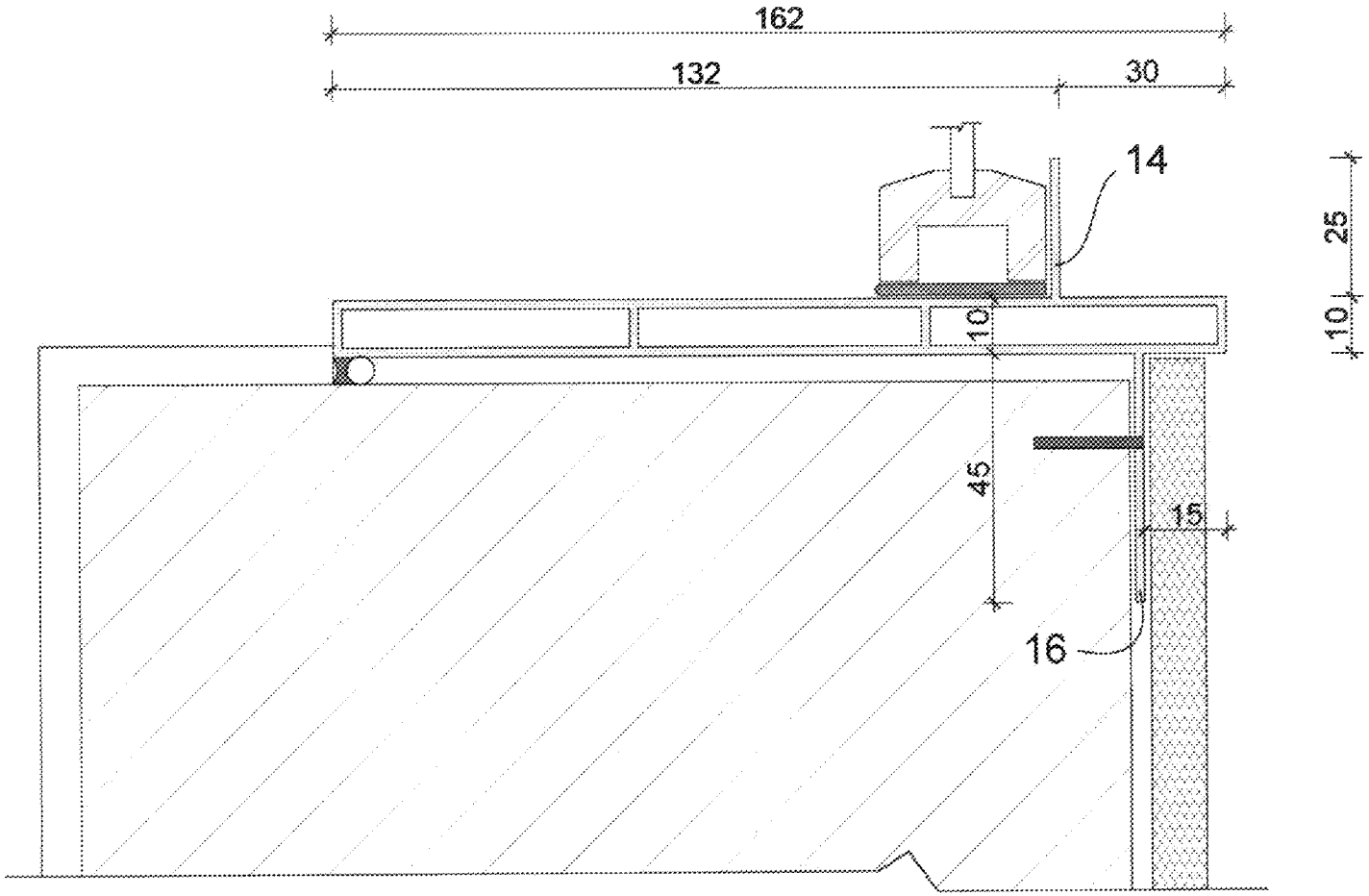
Figure 15 190MM MASONRY 30MM REVEAL

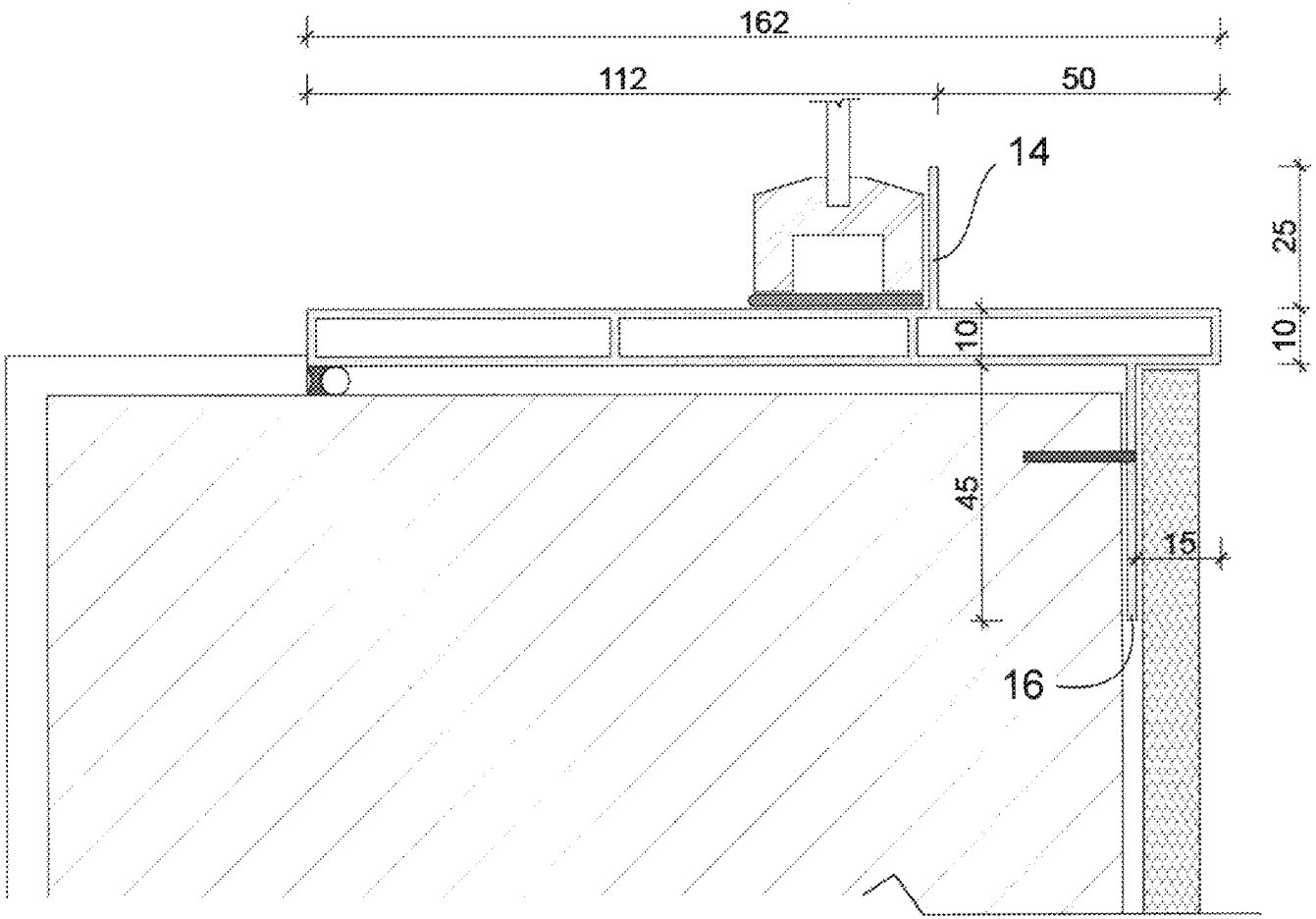
Figure 16 190MM MASONRY 50MM REVEAL

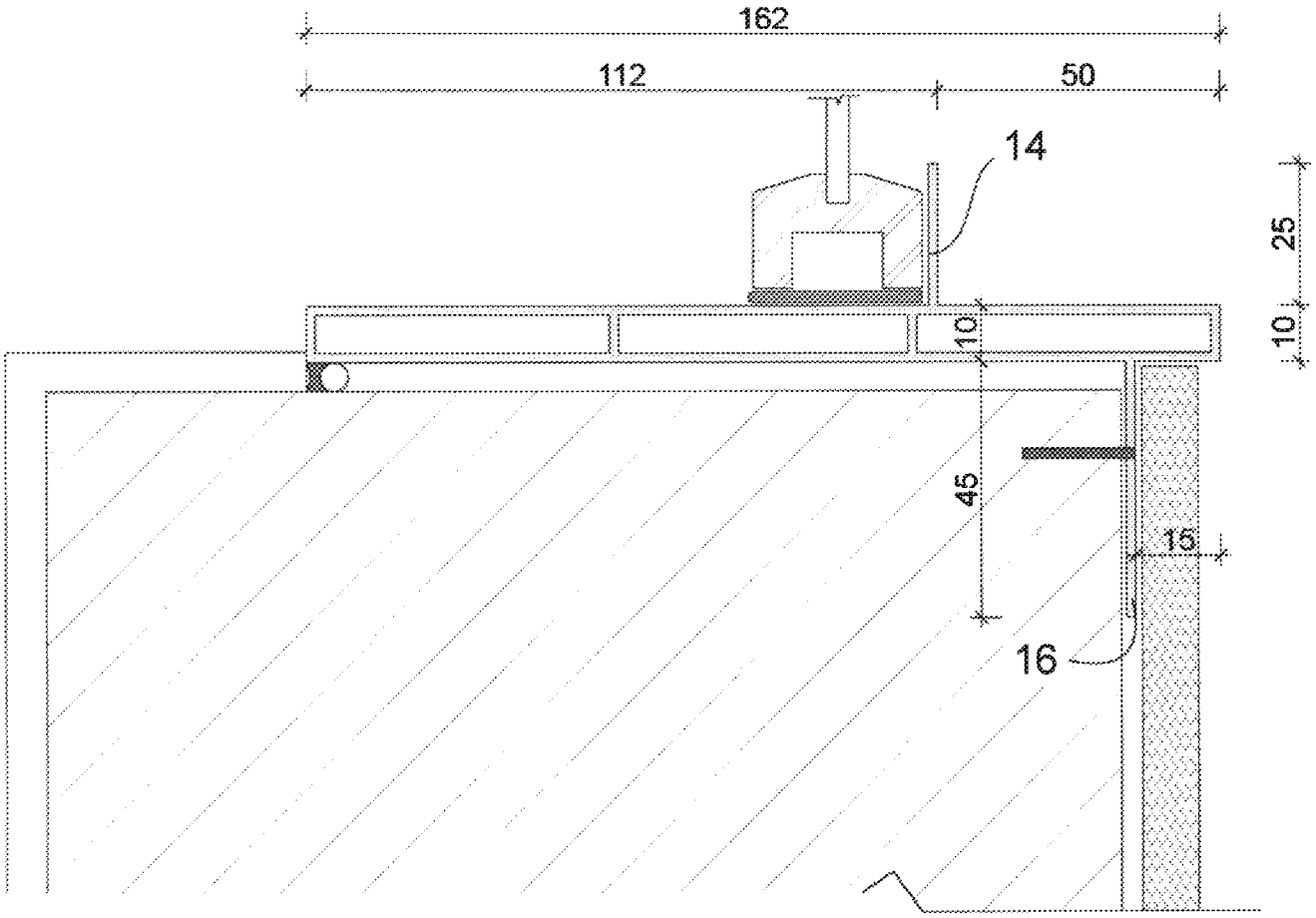
Figure 17 190MM MASONRY 50MM REVEAL

FLASHING AND JOINER FOR WINDOW INSTALLATIONS

CROSS REFERENCE TO RELATED APPLICATION

This application takes priority from and claims the benefit of Australian Patent Applications No. AU 2013901507 filed on Apr. 30, 2013 and No. AU 2013903516 filed on Sep. 12, 2013.

TECHNICAL FIELD

The present invention is directed to a flashing, and to a frame comprised of a number of lengths of the flashing, for use in the installation of building openings such as window frames.

BACKGROUND

Any references to methods, apparatus or documents of the prior art are not to be taken as constituting any evidence or admission that they formed, or form part of the common general knowledge.

Many buildings are constructed about a timber or steel framework. The framework is typically covered with a membrane and cladding on its outer side. The cladding may be any of a number of different types. For example, it is known to use timber and also synthetic weatherboards, a single layer of brick or even rendered polystyrene foam.

Window frames are set into the building framework and usually the cladding butts up against the window frame. Given the myriad of cladding types and building construction styles the junction between the window frame and the cladding is often problematic since it varies depending on the type of window frame and the type of cladding in each construction situation.

It would be desirable if a product were provided that made for a consistent platform for window installation and which was suitable for most commonly used window types, configurations and cladding types.

In addition to the above concern, whenever a window is installed into a building wall there is a possibility that the window frame could leak.

However, the sill of the window frame should not be completely sealed as drainage must be incorporated into the sill to allow for the discharge of moisture such as condensation which may build up around the window.

It would be desirable if a product were provided that would support the frame but at the same time encourage drainage of condensation to an outside of the frame and which would present an obstacle to ingress of condensation or other moisture into the building.

It is an object of the invention to provide a product which addresses one or more of the above described problems or which is at least a commercially attractive alternative to those products that have hitherto been known in the prior art.

SUMMARY OF THE INVENTION

According to a first aspect of the present invention there is provided a support frame for a window frame, the support frame comprising:

four sections of flashing each said section of flashing including:

a window frame support plate having a window frame side and building framework side, a first longitudinal wall extending from the window frame side of the support plate, and one or more longitudinal stiffening box sections continuous with said plate for imparting rigidity thereto, wherein two of the sections comprise sill and header flashings spaced apart at either end by the remaining two sections, which comprise jamb flashings; and joiners connecting adjacent ends of said four sections, each joiner including one or more pairs of biscuit portions with each biscuit of a pair being dimensioned to be received into a box section of a respective flashing, wherein, in use the first longitudinal wall presents a barrier to the progress of moisture.

In a preferred embodiment of the invention each section of the flashing further includes a second longitudinal wall extending from the building framework side thereof for reception between layers of the building framework.

The second longitudinal wall may include at least one line of weakness for detaching said wall if desired.

Preferably each joiner includes a first slotted member for receiving an end of the first wall of the previously described flashing.

It is preferred that each joiner also includes a second slotted member for receiving an end of the second wall of the flashing.

In a further aspect of the invention there is provided a support frame as previously described in combination with spacers wherein the spacers are located upon the window support plate with spaces therebetween for condensation from the window frame to egress therethrough.

Another aspect of the invention encompasses a window installation comprising a support frame as previously described in combination with a window frame.

According to another aspect of the present invention there is provided a flashing for supporting a window frame, including:

a window frame support plate having a window frame side and building framework side;

a first longitudinal wall extending from the window frame side of the support plate; and a longitudinal stiffening formation continuous with the plate for imparting rigidity thereto.

In a further embodiment of the invention a window frame support frame may be provided that comprises four lengths of the flashing joined together wherein two of the sections comprise sill and header flashings spaced apart at either end by the remaining two sections comprise jamb flashings.

According to another aspect of the present invention there is provided a joiner corresponding to a flashing according to claim 8 including one or more pairs of biscuit portions wherein the longitudinal stiffening formation of the flashing includes one or more box sections and wherein each biscuit of the pair is dimensioned to be received into one of said box sections.

Each joiner may include a first slotted member for receiving an end of the first wall of the flashing.

Preferably the joiner includes a second slotted member corresponding to a second wall of the flashing.

Preferably the longitudinal stiffening formation comprises at least one longitudinal box section.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows:

FIG. 8*a* shows a window flashing according to a further embodiment of the present invention.

FIGS. 9 to 17 show flashings according to further embodiments of the invention in use.

DETAILED DESCRIPTION OF PREFERRED EMBODIMENTS

Figure 1:
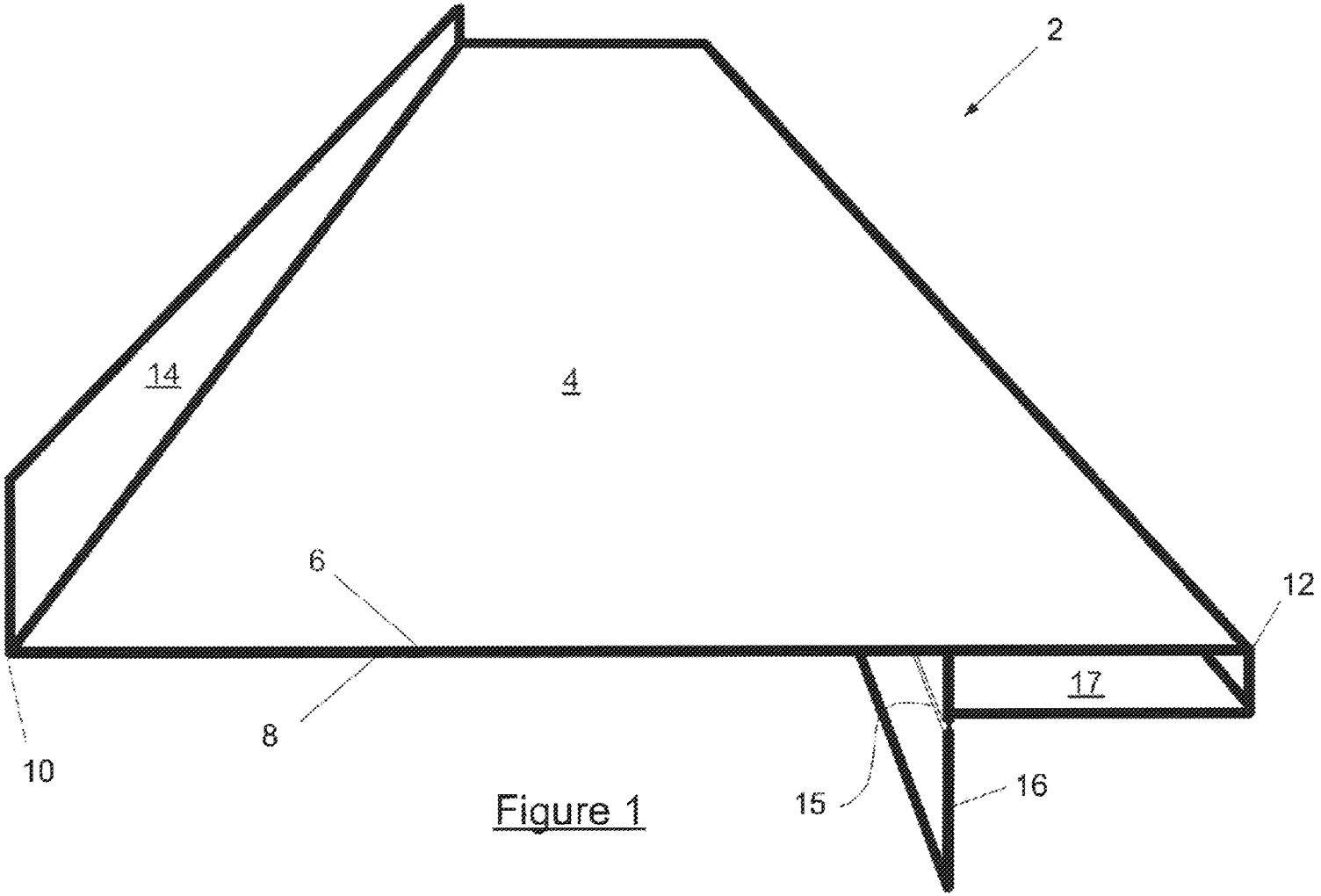
FIG. 1 is a single point perspective view of the end and window frame side of a flashing according to a preferred aspect of the present invention.
Figure 2A:
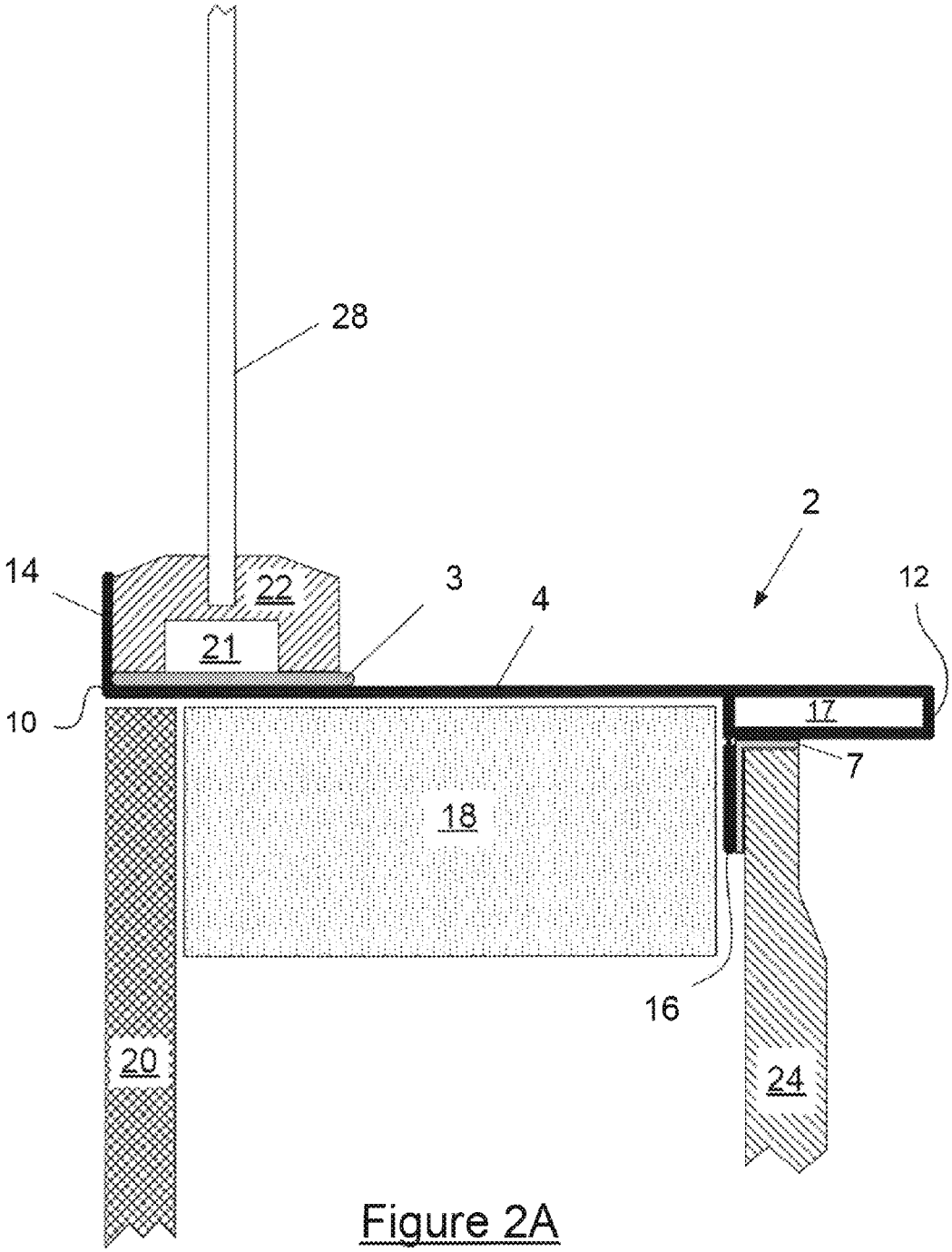
FIG. 2A is a cross section view of the flashing of FIG. 1 in use supporting a sill of a window frame.
Figure 2B:
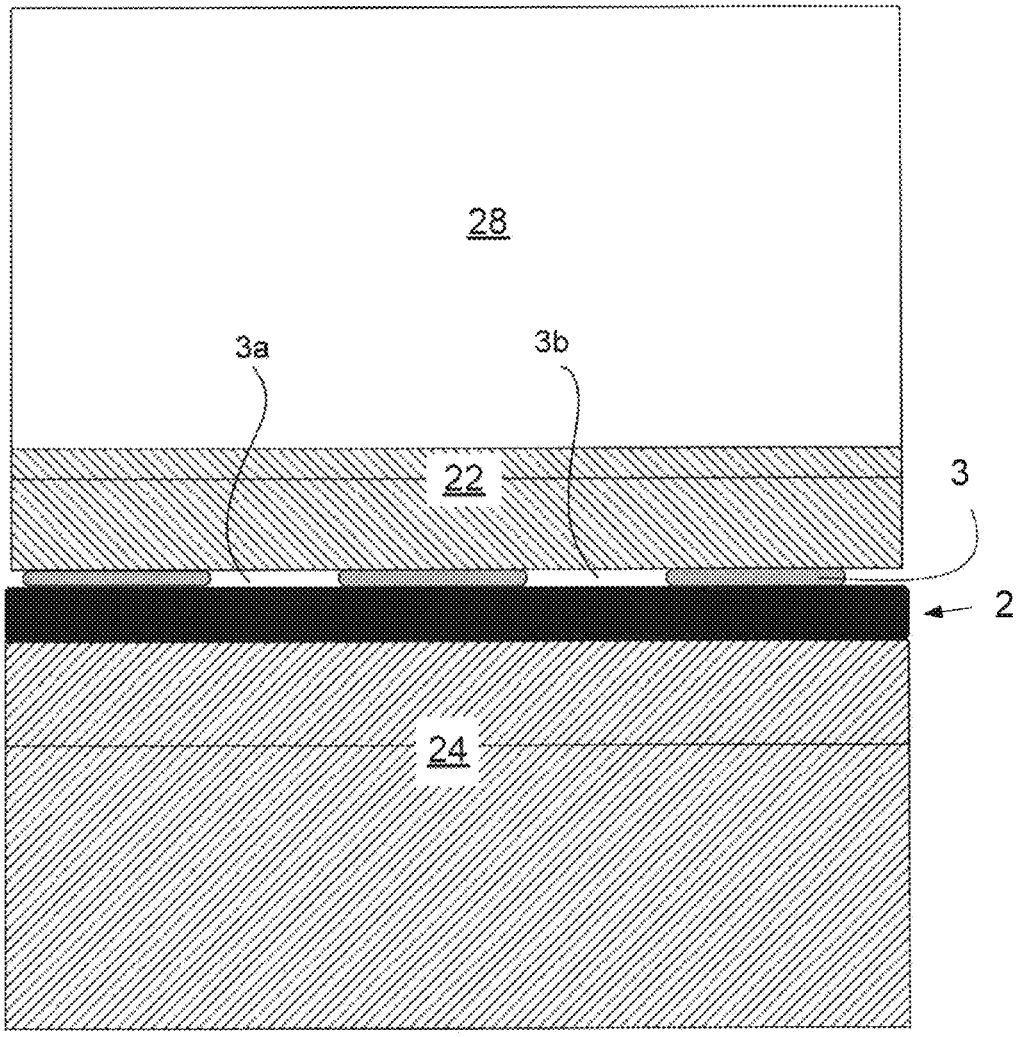
FIG. 2B a front plan view of the assembly depicted in FIG. 2A.

Referring now to FIG. 1, there is shown in single point perspective view, a length of a flashing 2 according to a preferred embodiment of the present invention. FIG. 2A is an end view of the flashing 2 in use installed in a wall of a building and supporting a window frame. FIG. 2B is a front plan view of the assembly depicted in FIG. 2A.

Flashing 2 is preferably formed as an aluminum extrusion, though other types of material, for example various plastics, may also be suitable.

The flashing comprises an elongate window frame support plate 4 which has a window frame support side 6 (identified in FIG. 1) and opposite thereto a building framework side 8. The flashing has an inner end 10, which in use is toward or inside the interior of the building in which it is installed, and an outer end 12, which locates proximate the exterior of the building in use.

Extending from the window frame side of the inner end there is a first longitudinal wall or "fin" or "upstand" 14. Furthermore, extending outward (in fact downward as shown in FIG. 2A) from the building framework side 8 of the support plate 4, toward the outer end 12, there is a second longitudinal wall 16. The second longitudinal wall includes one or more lines of weakness 15 (visible in FIG. 1) so that a portion of the second longitudinal wall can be detached if desired.

For example, where the flashing is used in a block construction building it may be desirable to detach the portion of the second longitudinal wall.

A longitudinal stiffening formation in the form of a box section 17 is located on the building frame work side 8 of the support plate 4 towards the outside end 12 thereof. The box section 17 imparts rigidity to the plate.

As can be seen in FIGS. 2A and 2B, the first longitudinal wall 14 and the second longitudinal wall 16 are sufficiently spaced to accommodate the building framework 18 and internal wall cladding 20 therebetween. Timber framework cladding is typically around 90 mm in thickness and internal wall cladding about 12 mm.

It will be realized that different versions of the flashing may be provided to accommodate narrower or broader widths of building material.

It will be observed in FIGS. 2A and 2B that the sill 22 of a window frame is supported on the plate 4 adjacent the first longitudinal wall 14 and seated upon a series of spaced apart nylon packers 3 with drainage and pressure equalization gaps 3B located therebetween.

The sill 22 is attached to the first longitudinal wall 14 by means of a series of rivets (not shown) with sealant (not shown) disposed between the longitudinal wall 14 and the sill 22. The sill 22 is typically comprised of an aluminum window frame extrusion as is well known. Such extrusions come in many different shapes and often include internal voids or cavities which are prone to collecting condensation. Such a cavity is indicated as item 21 in FIG. 2A.

The second longitudinal wall 16 is disposed between the framework 18 and external cladding 24. The cladding 24 is fastened to the framework 18 through the second longitudinal wall 16, for example by a series of nails (not shown). A suitable sealant 7 is disposed between the cladding 24, the box section 17 and the second longitudinal wall 16 as shown in FIG. 2A.

Figure 3:
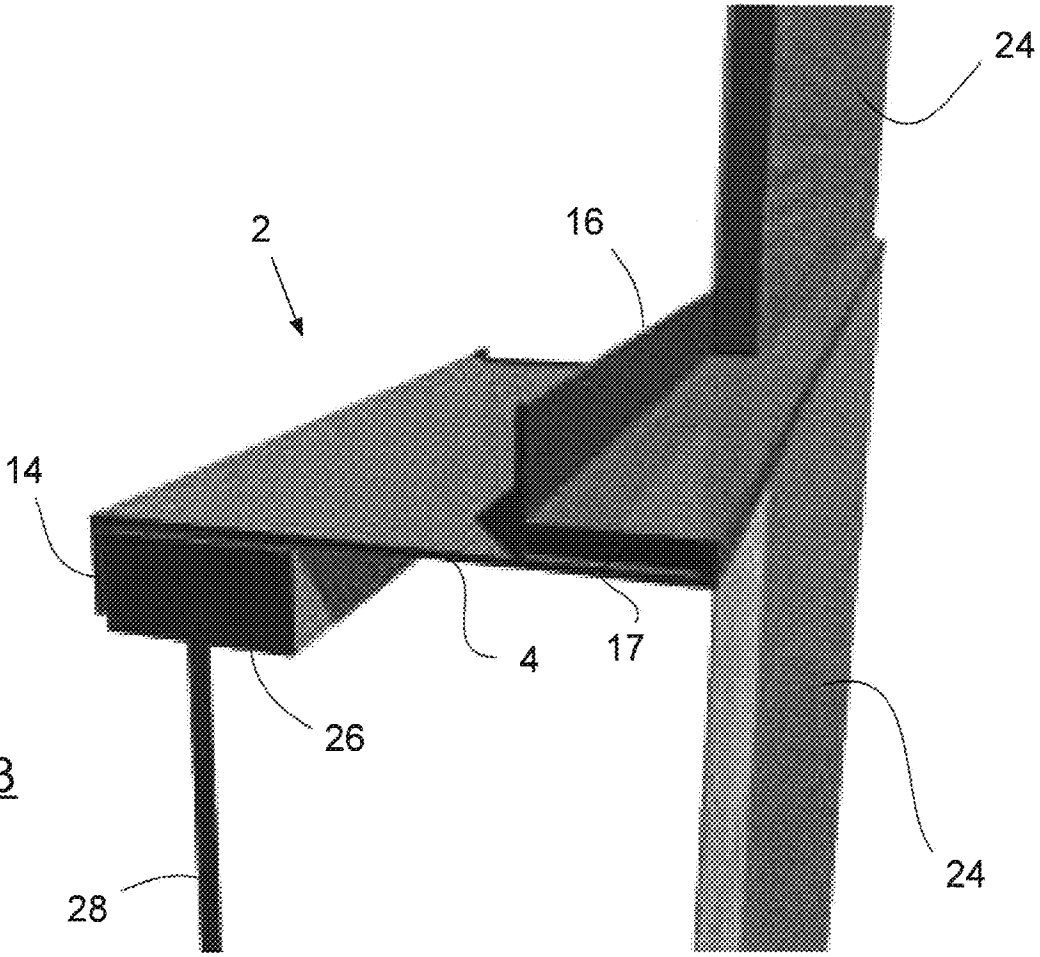
FIG. 3 is a perspective and partial view of the flashing of FIG. 1 in use above the header of a window frame.

FIG. 3 is a further view showing header 26 of the window frame, glass pane 28, external cladding 24 and flashing 2.

Figure 4:
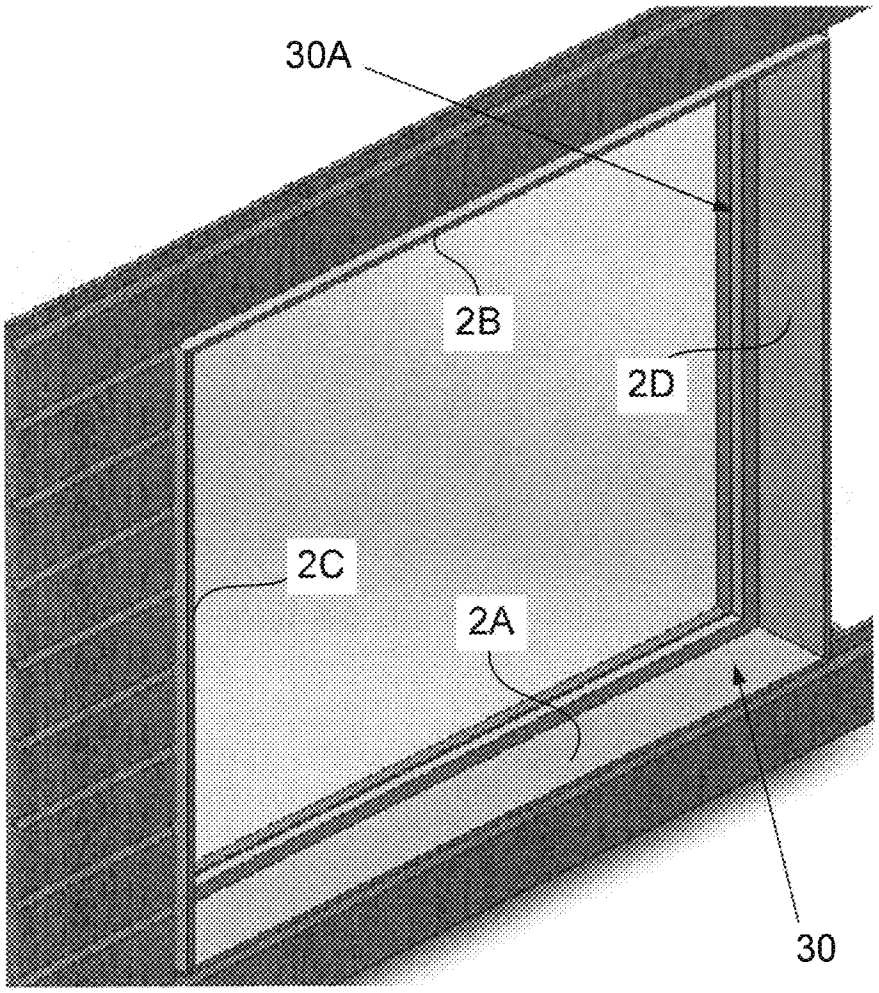
FIG. 4 shows a window frame support frame comprised of four lengths of the flashing of FIG. 1 in use.

FIG. 4 depicts the exterior of a window frame support frame 30 according to a preferred embodiment of a further aspect of the present invention in use. The window frame support frame 30 comprises four sections of the previously described flashing 2 joined together, preferably by mitering the ends together. Two of the sections comprise sill 2A and header 2B flashings spaced apart at either end by the remaining two sections, which comprise jamb flashings 2C, 2D. The window frame support frame 30 is shown supporting a window frame 30A.

Figure 5:
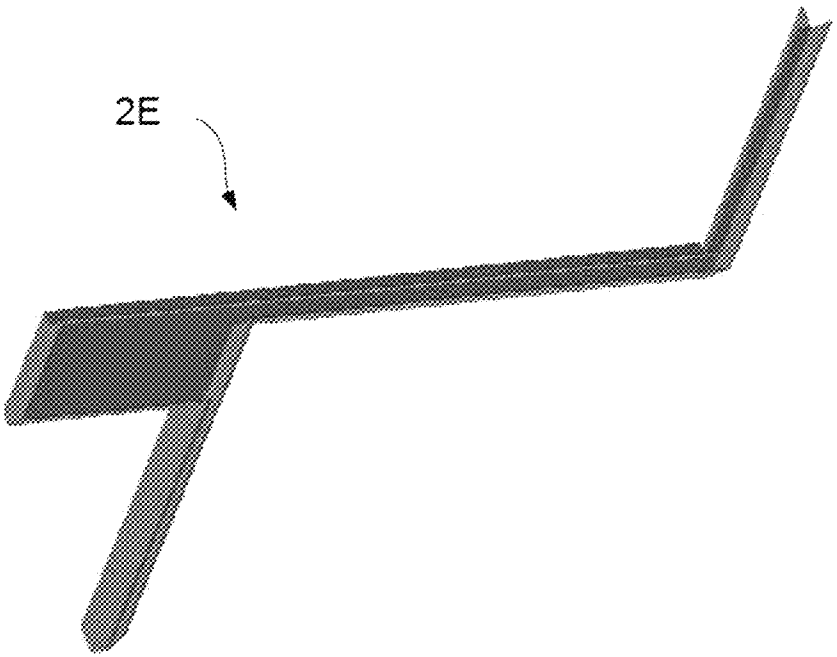
FIG. 5 shows a biscuit joiner for joining lengths of the flashing of FIG. 1 together to form the window frame support frame of FIG. 4.

It is most convenient to join the four lengths of flashing 2A-2D (which comprise the support frame 30) together at their ends by using a suitably shaped biscuit joiner 2E as illustrated in FIG. 5 and a suitable sealant.

Figure 6:
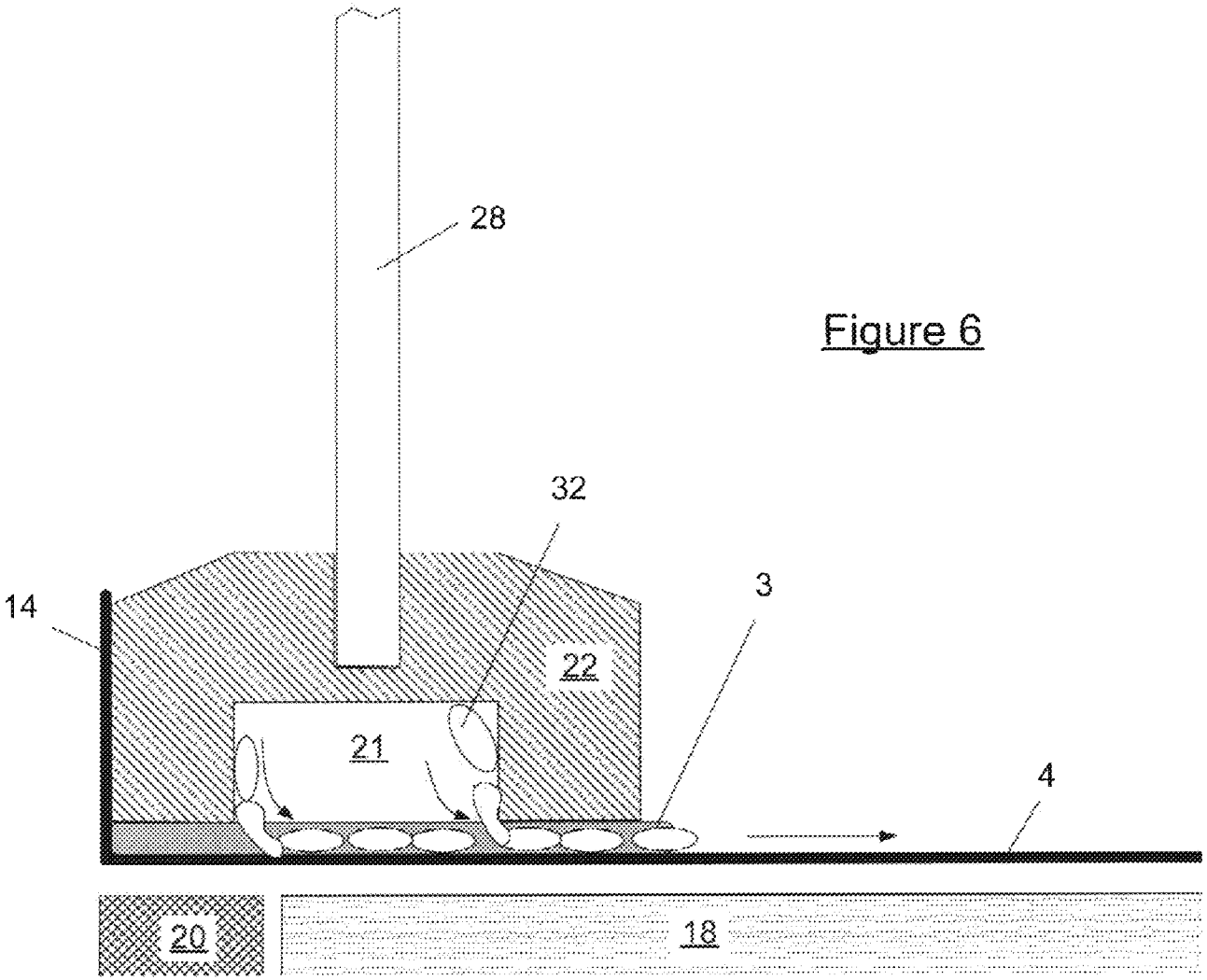
FIG. 6 shows an inside portion of the flashing of FIG. 1 in use adjacent a sill of a window frame.

Referring now to FIG. 6, in use the flashing 2 is installed as shown in FIG. 2 or as part of the frame 30 shown in FIG. 4.

Drops of condensation 32 may form inside the cavity 21 of the sill 22. Those drops are able to flow as indicated in FIG. 6. That is, the drops 32 flow through the drainage and pressure equalization gaps 3B between the spacers 3 and along the support plate 4 and thence to the outside.

Consequently, condensation is able to exit from the window frame without damaging the internal cladding 20 (visible in FIG. 6 for example) or the framework 18 since the internal wall 14 presents an obstacle to the condensation and other external moisture, entering the building.

Figure 7:
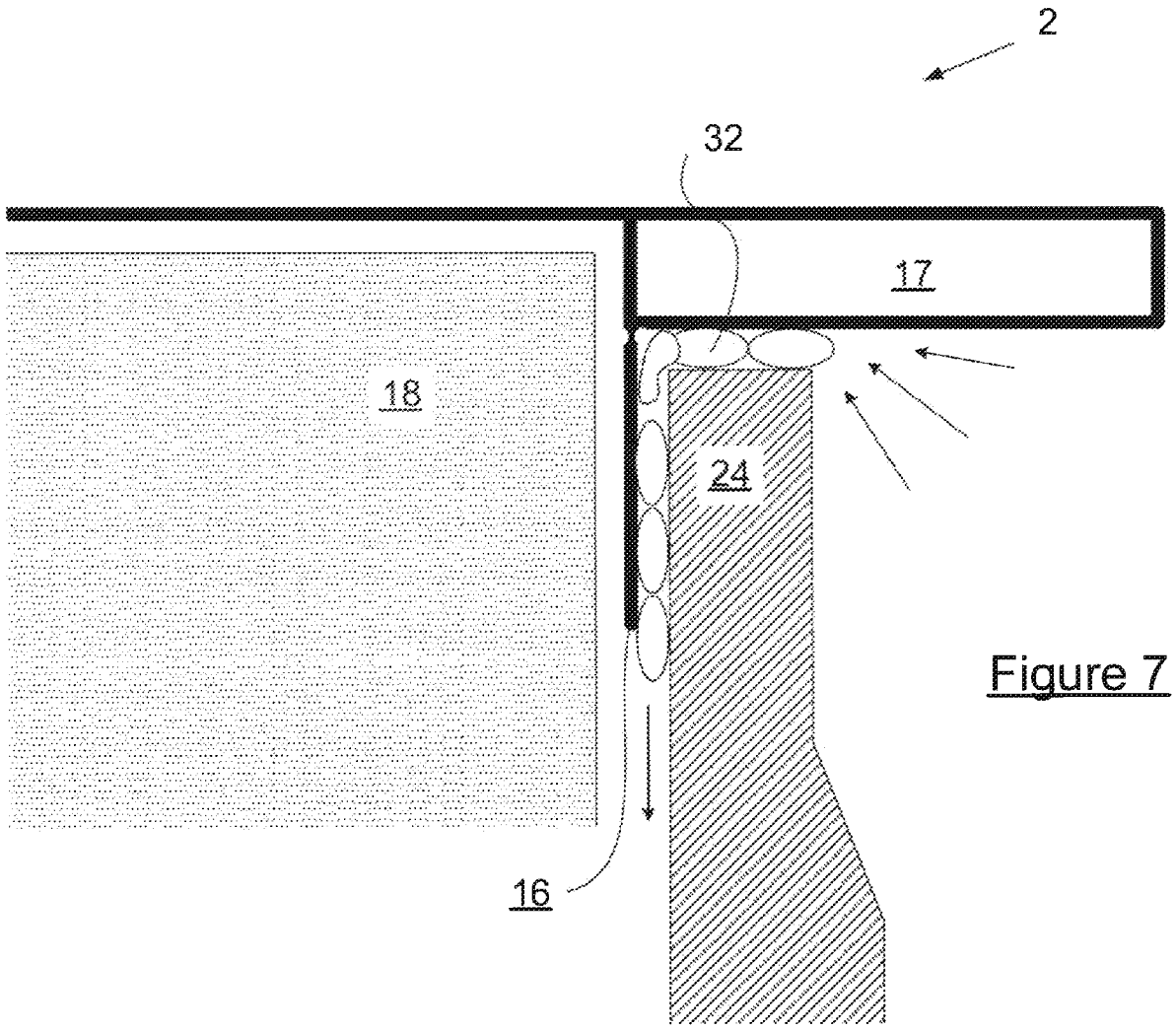
FIG. 7 shows an outside portion of the flashing of FIG. 1 in use adjacent an outer cladding of a building.

Furthermore, as shown in FIG. 7, in the event of sealant 7 (shown in FIG. 2A) deteriorating, water 34 impacting upon the underside of the external box section 17, even if it makes its way between the section and the cladding, will be diverted down and away from the building framework adjacent the sill 22 by the second longitudinal wall 16. Consequently the framework 18, and any internal membrane (not shown) is protected from contact with water 34.

Referring now to FIG. 8*a* there is shown a flashing 36 according to a further embodiment of the present invention. The flashing of FIG. 36 is formed with three longitudinal box cavities 38, 40 and 42 which assist in making the extrusion lightweight while at the same time imparting rigidity along the length of the extrusion. In this embodiment the longitudinal wall 14 (or as it could also be called "the fin 14") is flush with the interior side 44 of the innermost box cavity 42.

Figure 8B:
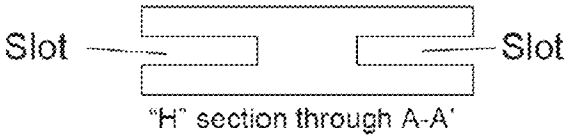
FIG. 8*b* shows a joiner for forming lengths of the flashing of FIG. 8 into a frame
Figure 8B:
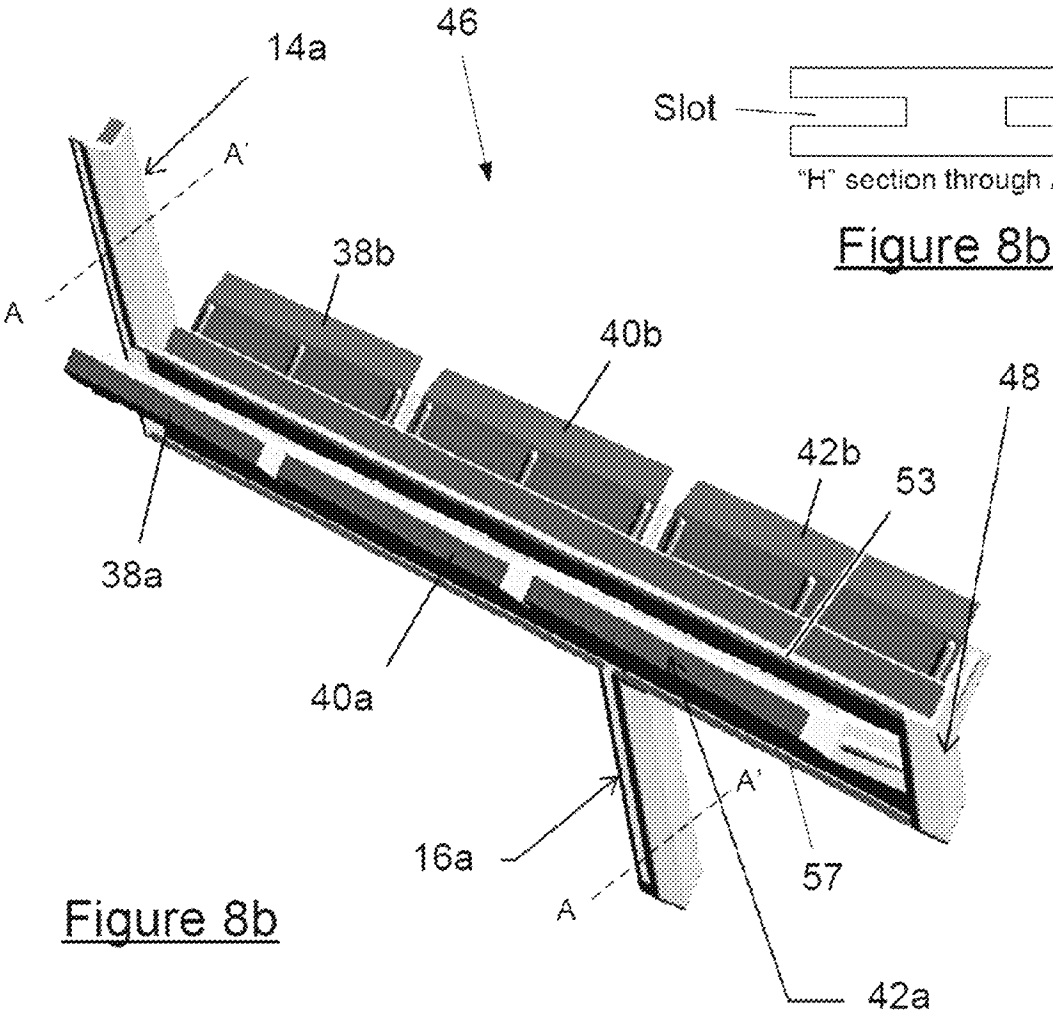
Figure 8C:
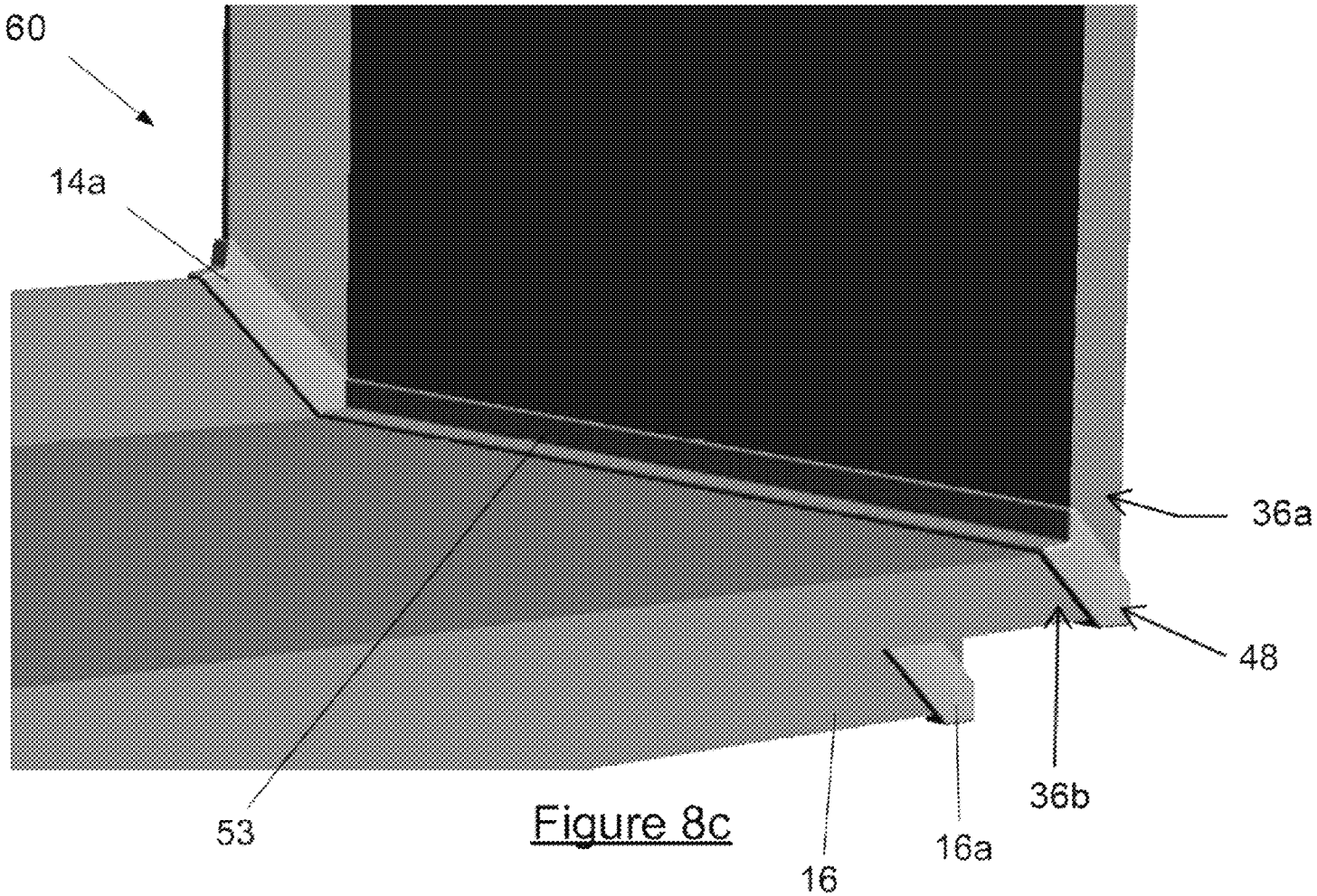
FIG. 8*c* shows the joiner of FIG. 8*b* in use joining two of the flashings of FIG. 8*a* at right angles.

Referring now to FIG. 8*b*, there is shown a joiner for joining mitered extrusions as shown in FIG. 8*a* together to produce the resulting join that is shown in FIG. 8*c*. The joiner 46 of FIG. 8*b* includes a leg 14*a* having slotted sides for accommodating the edge of the upturns or "walls" 14 of the extrusions. The leg 14*a* is shown in FIG. 8*b* flush with the end of the joiner however it may be offset from the end to accommodate a window reveal set in from the end as shown in FIGS. 9 to 13 for example. The leg 14*a* has an "H" shaped cross section as shown in the detail cross sectional view in FIG. 8*ba*.

The joiner 46 is provided with six biscuits 38*a*, 38*b*, 40*a*, 40*b*, 42*a*, 42*b* that are paired, with each member in a pair being set at an angle of 90 degrees to each other as shown. Each biscuit is received into a corresponding cavity of a box section 38 to 32 of the flashing 36 so that the resulting joint has strength and stability.

A lower leg 16*a* is provided also of "H" style cross section so that it may accommodate the wall of the extrusion that fixes to the structural frame or masonry substrate. Different embodiments of the joiner have this leg set at different positions along the joiner to accommodate extrusions that suit, for example, 70 mm frame, 90 mm Frame and masonry installation.

Covers 53 and 57 run over the outside of the biscuits so that a gap is left between the covers and the biscuits that is sufficient to snugly receive the ends of the box sections 38 to 32 of the flushings 36. Accordingly it will be understood that the joiner provides a snug seal to the ends of the flushings 36. Consequently a suitably rigid frame of the type illustrated as item 30 of FIG. 4 may be readily fabricated from four joiners 46 and four lengths of flashing 36. FIG. 8C shows a detail of a frame 60 with sill section 36*b* jamb section 36*a* joined by joiner 48. Furthermore, slots in the legs 14*a* and 16*a* and the gaps provided between the biscuits and the covers 53 and 57 are sufficient to allow for variations in the cutting of the ends of the extrusion and also for expansion and contraction of the extrusion.

The remaining FIGS. 9 to 17 illustrate further window flashings according to further embodiments of the invention. It will be observed that they may be used in both timber frame and masonry (e.g. block or brick) constructions. FIGS. 9 to 17 include dimensions which are all in millimeters. It will be understood that the dimensions are provided to indicate the size of preferred embodiments of the invention are not limiting since differently dimensioned variations of the invention may be used in and furthermore product according to embodiments of the invention may be provided in corresponding imperial dimensions, i.e. in inches and fractions of inches for example.

Joiners similar to that of FIG. 8*b* may be used with each of these extrusions provided that they correspond to the particular shape of the extrusion in question.

In compliance with the statute, the invention has been described in language more or less specific to structural or methodical features.

The term "comprises" and its variations, such as "comprising" and "comprised of" is used throughout in an inclusive sense and not to the exclusion of any additional features. It is to be understood that the invention is not limited to specific features shown or described since the means herein described comprises preferred forms of putting the invention into effect. The invention is, therefore, claimed in any of its forms or modifications within the proper scope of the appended claims appropriately interpreted by those skilled in the art.

Throughout the specification and claims (if present), unless the context requires otherwise, the term "substantially" or "about" will be understood to not be limited to the value for the range qualified by the terms.

Any embodiment of the invention is meant to be illustrative only and is not meant to be limiting to the invention. Therefore, it should be appreciated that various other changes and modifications can be made to any embodiment described without departing from the spirit and scope of the invention.

I claim:

1. A support frame for a window frame, the support frame comprising:

four sections of flashing connected to each other at right angles to form a rectangular support frame each said section of flashing including:

a window frame support plate having a window frame side and building framework side, a first longitudinal wall extending from the window frame side of the support plate, a second longitudinal wall extending from the building framework side thereof for reception between layers of a wall of the building and one or more longitudinal stiffening enclosed box sections continuous with said plate for imparting rigidity thereto, wherein two of the sections comprise sill and header flashings spaced apart at either end by the remaining two sections, which comprise jamb flashings; and separate joiners connecting adjacent ends of said four sections, each joiner including one or more pairs of biscuit portions with each biscuit of a pair being dimensioned to be received into the enclosed box section of a respective flashing, each joiner including a cover which covers the otherwise visible join line formed when two said sections are joined at right angles, a first slotted member for receiving an end of the first wall of the flashing, and a second slotted member for receiving an end of the second wall of the flashing;

wherein, in use the first longitudinal wall presents a barrier to the progress of moisture.

2. A support frame according to claim 1, wherein the second longitudinal wall includes at least one line of weakness for detaching said wall if desired.

3. A support frame according claim 1 in combination with spacers wherein the spacers are located upon the window support plate with spaces therebetween for condensation from the window frame to pass therethrough.

4. A window installation comprising a support frame according to claim 1 in combination with the window frame.

5. A joiner corresponding to a flashing, the flashing including a window frame support plate having a window frame side and building framework side, a first longitudinal wall extending from the window frame side of the support plate to present a barrier to the progress of moisture in use, a second longitudinal wall extending from the building framework side thereof for reception between layers of a wall of the building, and one or more longitudinal stiffening enclosed box sections continuous with said plate for imparting rigidity thereto, the joiner including: one or more pairs of biscuit portions with each biscuit of the pair being dimensioned to be received into one of said box sections, the joiner having a cover which covers an otherwise visible join line formed when two said flashings are joined at right angles the cover being integrally formed with a first slotted member for receiving an end of the first longitudinal wall of the flashing and with a second slotted member for receiving an end of the second wall of the flashing.

* * * * *